US007349651B2

(12) United States Patent
Fernandez

(10) Patent No.: US 7,349,651 B2
(45) Date of Patent: Mar. 25, 2008

(54) SYSTEM AND METHOD FOR BRANDING A DOCUMENT

(75) Inventor: Simon Fernandez, London (GB)

(73) Assignee: Xerox Corporation, Norwalk, CT (US)

( * ) Notice: Subject to any disclaimer, the term of this patent is extended or adjusted under 35 U.S.C. 154(b) by 254 days.

(21) Appl. No.: 11/292,202

(22) Filed: Nov. 30, 2005

(65) Prior Publication Data

US 2007/0122191 A1 May 31, 2007

(51) Int. Cl.
*G03G 21/00* (2006.01)

(52) U.S. Cl. ..... 399/130; 283/36; 283/40; 399/1

(58) Field of Classification Search ..... 399/130, 399/1; 358/2.1; 355/40; 101/483, 476; 283/36, 37, 38, 40, 42
See application file for complete search history.

(56) References Cited

U.S. PATENT DOCUMENTS 4,427,290 A * 1/1984 Kaye et al. ..... 355/40
6,048,114 A * 4/2000 de Troz ..... 283/38 X
6,478,337 B1 * 11/2002 Toda et al. ..... 283/38

FOREIGN PATENT DOCUMENTS

JP 10-044552 A * 2/1998

* cited by examiner

*Primary Examiner*—Sophia S. Chen
(74) *Attorney, Agent, or Firm*—Fay Sharpe LLP

(57) ABSTRACT

A method for branding a multi-page document includes receiving a branding image, dividing the branding image into a plurality of sub-images, and distributing the plurality of sub-images over a respective plurality of pages of a multi-page document. The sub-images are distributed at or adjacent an edge of the prospective pages whereby when the respective pages of the multi-page document are bent in preparation to be flipped the sub-images appear as a reconstructed version of the branding image. A system for branding a document is also provided.

16 Claims, 4 Drawing Sheets

SYSTEM AND METHOD FOR BRANDING A DOCUMENT

BACKGROUND

When handling a thick document, a natural reaction when picking up the document is to flick or flip through it. In doing so, the document is bent to reveal a small portion of the edge of each page of the document, typically opposite the spine or bound portion of the document. Typically, this small portion of the document is left blank and unused.

Documents such as annual statements, advertising documents, manuals and the like can become more attractive if they were to include branding images formed or displayed with the document.

BRIEF DESCRIPTION

A method for branding a multi-page document includes receiving a branding image, dividing the branding image into a plurality of sub-images, and distributing the plurality of sub-images over a respective plurality of pages of a multi-page document. The sub-images are distributed at or adjacent an edge of the prospective pages whereby when the respective pages of the multi-page document are bent in preparation to be flipped the sub-images appear as a reconstructed version of the branding image.

A system for branding a document includes a document processor, a branding image receiver, a branding image divider, and a sub-image distributor. The branding image receiver is configured to receive branding image information describing a branding image for a multi-page document. The branding image divider communicates with the branding image receiver and is configured to divide the branding image into a plurality of sub-images. The sub-image distributor communicates with the branding image divider and is configured to distribute the plurality of the sub-images over a plurality of pages of a multi-page document. The document processor communicates with at least one of the branding image receiver, the branding image divider and the sub-image distributor. The document processor is operative to locate the distributed plurality of sub-images adjacent to an edge of a plurality of pages of the multi-page document.

A method for branding a document includes receiving a branding image for a document having a plurality of pages, dividing the branding image into a plurality of sub-images, and distributing respective sub-images over respective pages of the document at or adjacent a respective front or rear selected edges of the respective pages. The sub-images are distributed whereby if a printed version of the document is manipulated to expose the selected edges then the sub-images appear as a reconstructed version of the branding image.

DETAILED DESCRIPTION

Figure 1:
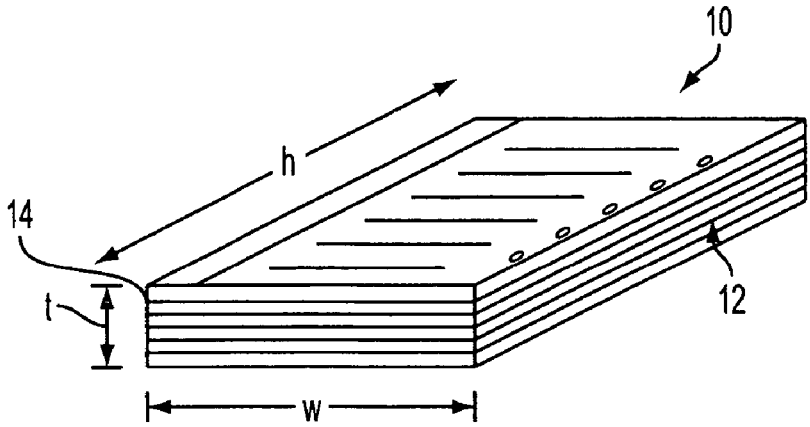
FIG. 1 is a perspective view of a multi-page document.
Figure 2:
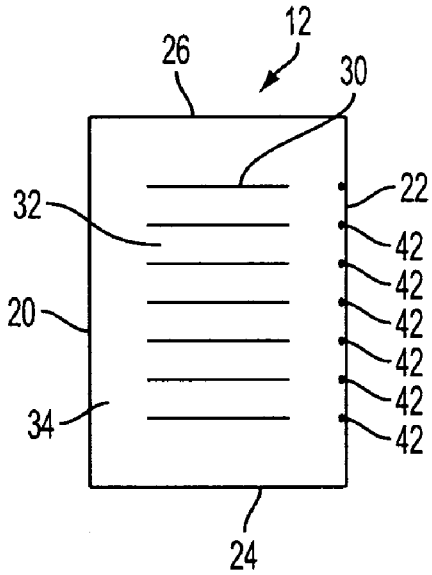
FIG. 2 is a plan view of a page of the multi-page document of FIG. 1.

As seen in FIG. 1, a bound multi-page document 10 generally includes a plurality of pages 12 that are attached to one another by a binding, which can include at least one staple, a ring binder, a velum binder, glue, string or other manners for attaching pages of a document together, at a spine 14. The entire edge of each page need not be bound. Instead, only a portion of each edge can be bound. For ease of explanation, the multi-page document 10 can be described as including a thickness t, a height h, and a width w. In one example, the height can equal 11 inches and the width can equal 8½ inches and the thickness is determined by the number of pages of the document. With reference to FIG. 2, each page 12 of the document 10 depicted in FIG. 1 includes four edges: a left edge 20, a right edge 22, a lower edge 24, and an upper edge 26. In alternative embodiments, the pages can take other configurations and each page can have a fewer or greater number of edges.

As depicted in FIG. 1, the document 10 is bound at or adjacent the left edge 20. As indicated above, the entire left edge 20 need not be bound. Alternatively, the document can be bound at or adjacent any other edge. With reference back to FIG. 2, text 30, or other images, are typically printed in a central region 32 of the page 12. A margin 34 surrounds the central region 32 and is disposed between the central region and the edges 20, 22, 24 and 26 of the page 12. The margin 34 can be divided into a lower margin, an upper margin, a left margin and a right margin.

When handling a thick document, such as the document 10 shown in FIG. 1, one tends to flick through or flip through the document. In preparation of flipping, the document 10 is manipulated to reveal a small portion of each page 12 (see FIG. 3), typically along an edge of the document opposite the spine 14, e.g. the right edge 22 in FIG. 2. This space, i.e. the small portion of the margin 34 adjacent the right edge 22, or any unbound edge, is typically an unused or blank area of the pages. If only a central portion of the left edge 20 is bound, the top edge 26 and bottom edge 24 can also be easily bent. A branding image 40, an example of which is disclosed in FIG. 3, can be displayed in this unused space. The branding image that is to be displayed can include a company name or logo, as well as, any text, graphics, pictures, etc., that one would like to display with a document. Also, the branding image can comprise a plurality of images to form a composite branding image.

Figure 5:
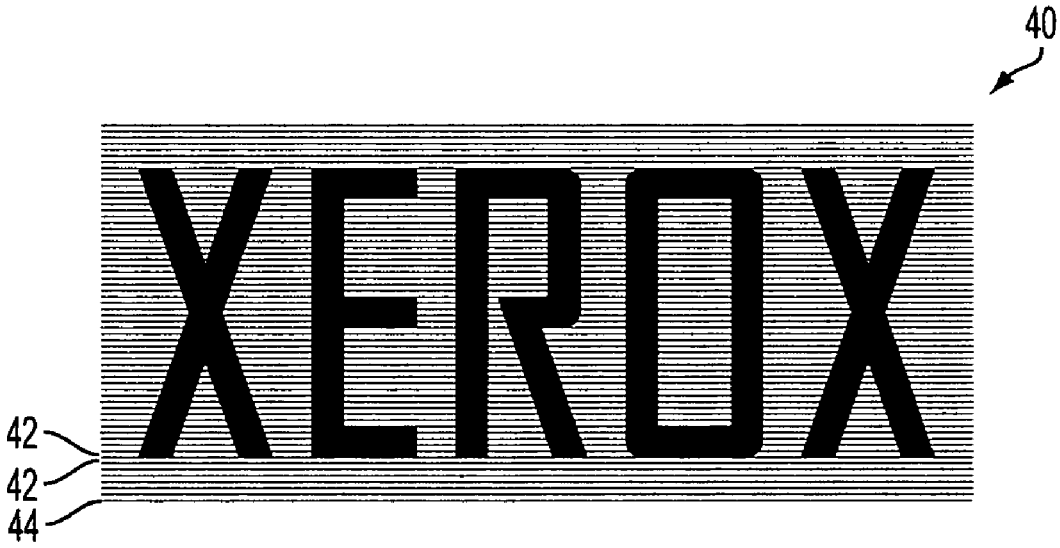
FIG. 5 is an example of the branding image of FIG. 4 divided into a plurality of sub-images.

The branding image 40 is to be displayed or revealed when one bends and/or manipulates the pages 12 prior to flipping through the pages. To accomplish this result, the branding image 40 is divided into a plurality of sub-images 42, for example as seen in FIG. 5, where a plurality of horizontal sub-images are shown separated by horizontal lines 44 that slice the branding image into the horizontal sub-images. In one example, each sub-image 42 is printed on a respective page 12 of the document 10 at or adjacent the right edge 22. Accordingly, when the document 10 is bent and/or manipulated prior to being flipped, a small portion of each page 12 near the right edge 22 is exposed, thus the branding image appears at or near the right edge of the document.

Figure 6:
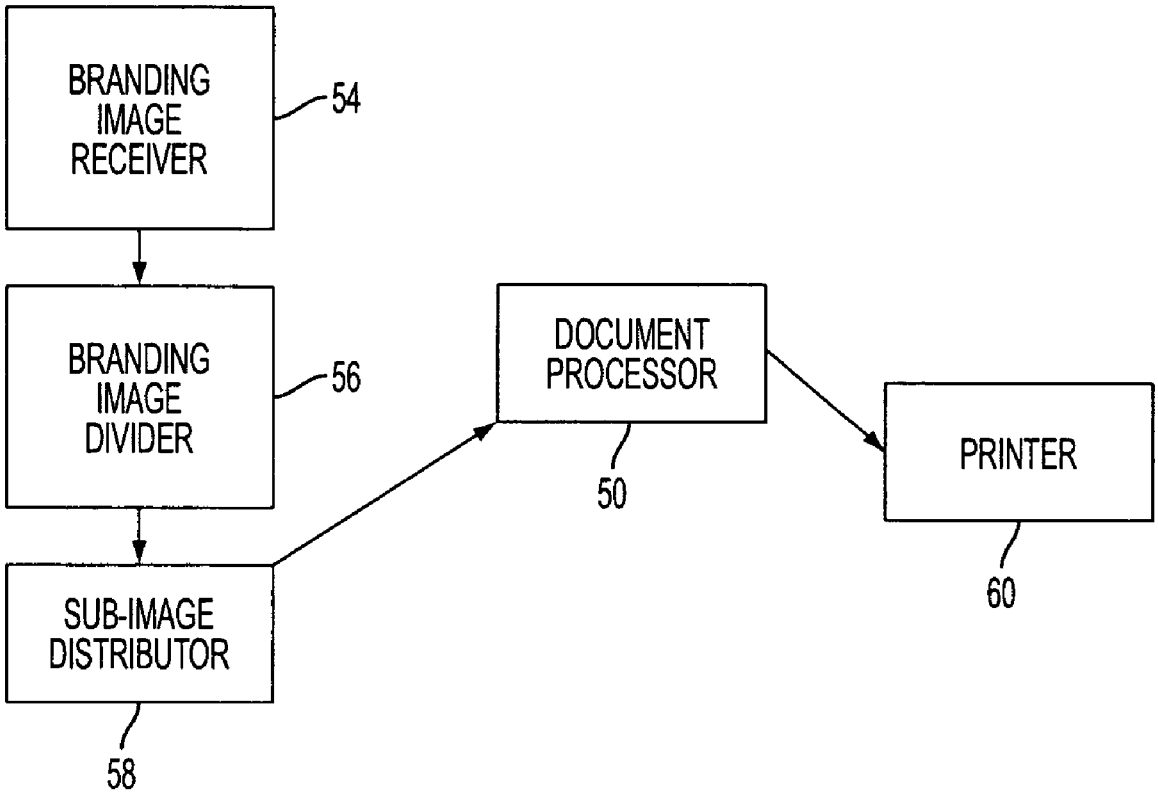
FIG. 6 is a schematic diagram of a device for branding a document.

An example of a system or device(s) used to brand a document is shown in FIG. 6. The system can include hardware and/or software operable to perform the described functions. The system includes a document processor 50, a branding image receiver 54, a branding image divider 56, and a sub-image distributor 58. In the depicted example, the document processor 50 prepares the page(s) 12 to be printed, e.g. the text or other graphics 32 depicted in FIG. 2.

The document processor 50 also locates the sub-images 42 (see FIG. 2) adjacent the edge, which can be any edge, on the proper pages of the document. The document processor 50 communicates with a printer 60 to print the pages of the document. The word "printer" as used herein encompasses any apparatus, such as a digital copier, bookmaking machine, facsimile machine, multi-function machine, etc. that performs a print outputting function for any purpose. The printer 60 is configured to print images in the margin 34, which can be any margin, e.g. lower, upper, left or right, very close to an edge of the page 12. The aforementioned components can either be located in the printer 60 or in a device, e.g. a processor, that is in communication with the printer 60.

Figure 3:
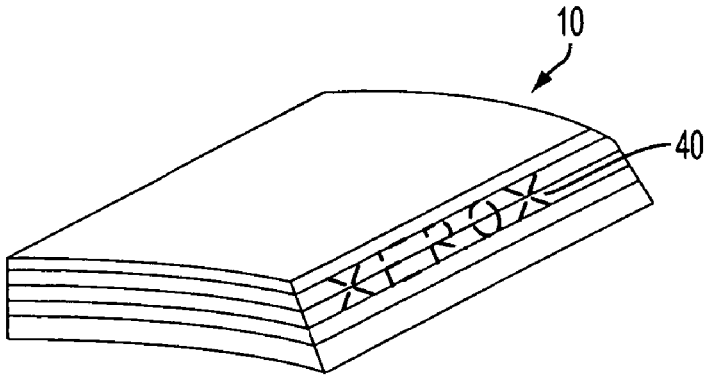
FIG. 3 is a perspective view of the multi-page document of FIG. 1 manipulated to reveal a branding image.

The branding image receiver 54 receives the branding image 40 (FIG. 4) that is to be displayed on the document 10 (FIG. 3). The branding image 40 can be input, for example, via a keyboard, a scanner, or via a file that is stored on a medium, as well as other manners. The branding image receiver 54 can also receive input as to which edge will carry the branding image. The branding image receiver 54 can also receive input regarding the alignment of the branding image. The alignment input can include whether the branding image 40 is to be centered along the height h (FIG. 1) or the thickness t (FIG. 1) of the document 10, for example where the branding image is printed on a right edge. Also, the branding image receiver 54 can receive input as to whether the branding image is to be right justified, left justified, aligned with the top page and/or aligned with the bottom page of the document. Additionally, where the branding image is received as text, the font, size, color and spacing can also be received the branding image receiver 54.

The branding image receiver 54 communicates with the branding image divider 56. The branding image divider 56 divides or slices the branding image 40 into a plurality of sub-images 42 that are distributed throughout respective pages 12 of the document 10. Using the example of the branding image 40 depicted in FIG. 4, the branding image divider 56 slices the branding image 40 into a plurality of sub-images 42, for example the horizontal sub-images as depicted in FIG. 5.

The sub-image distributor 58 communicates with the branding image divider 56 and the branding image receiver 54. The sub-image distributor 58 distributes the sub-images 42 provided by the branding image divider 54 throughout respective pages 12 of the document 10 according to alignment information received from the branding image receiver 54. For instance, using the example of the branding image 40 depicted in FIG. 4, the sub-image distributor 58 distributes the uppermost sub-image 42 to an upper page, in relation to the thickness t of the document 10 (see FIG. 2) and further distributes sequential sub-images 42 moving down the branding image 40 to sequential pages 12 moving down the document 10.

Figure 4:
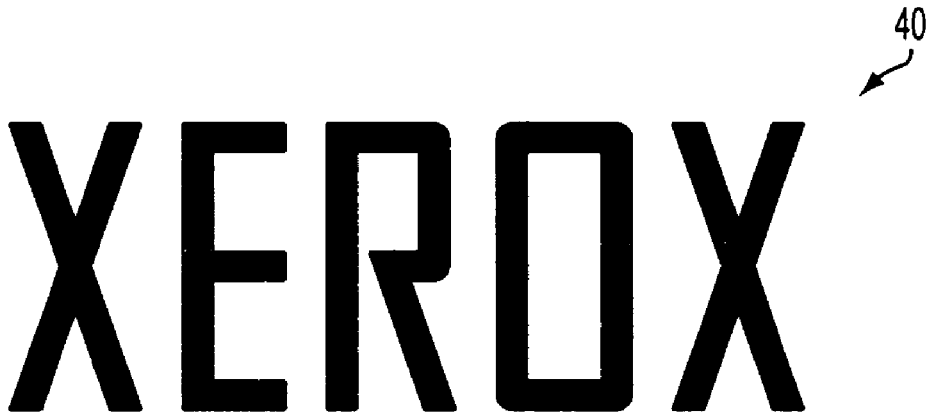
FIG. 4 is an example of a branding image for the multi-page document of FIG. 1.

The branding image divider 56 and the sub-image distributor 58 can perform functions differently if different results are desired. For example, instead of dividing the branding image 40 (FIG. 4) into horizontal slices as depicted in FIG. 4, the branding image divider 56 can divide the branding image into slices that are other than horizontal. Also, the breaks between sub-images 42 need not be straight lines. Instead, the sub-images can be curved.

In one example, the branding image divider 56 determines the number of sub-images 42 that are to be distributed as a function of the input received by the branding image receiver 54, i.e. font, size, spacing, alignment, etc., and the number of pages 12 of the document 10. The branding divider 58 can also determine the distance that the sub-image 42 that is printed on each page 12 extends towards the central region 32 (FIG. 2) of each page 10. This distance can also be a function of user input. Where fewer pages are provided, it may be desirable to increase the distance the sub-image 42 extends from the edge.

Figure 8:
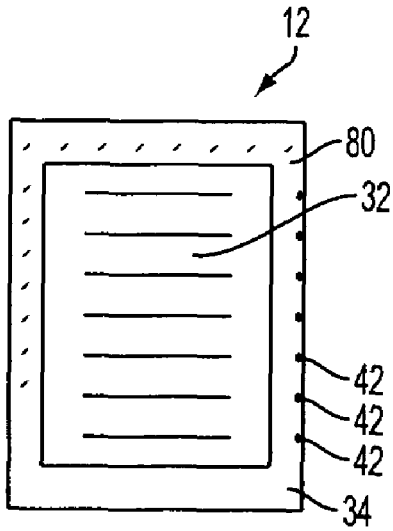
FIG. 8 is a plan view of an alternative embodiment of a page of the multi-page document of FIG. 1 showing a decorative border on the page.

The sub-image distributor 58 communicates with the document processor 50 so that the proper sub-image 42 is printed on the proper page 12 of the document 10. The sub-image distributor 58 and the document processor 50 cooperate to merge the sub-images 42 into or with the images or text 30 that is typically printed in the central region 32 of the respective page 12 (see FIG. 2). The document processor 50 communicates with the printer 60 so that the printer prints the document 10, which will include the text 30 and/or any images printed on the central region 32 of the pages 12 and also include the sub-images 42 printed adjacent an edge of the pages. With reference to FIG. 8, to obscure the sub-images 42 printed on each page so as not to detract from the document aesthetics, the sub-image can be printed as a part of a decorative border 80 that is formed in the margin 34.

To brand a document, the branding image 40 (FIG. 4) is received 100 (FIG. 7) by the branding image receiver 54. The branding image 40 can be in the form of an image data or text file and/or other input such as keyboard text entry or pointer device menu selections that are understandable by the branding image receiver 54 and/or document processor 50. When receiving the branding image 40, the branding image receiver 54 can also receive other information including the alignment of the branding image 40 (FIG. 4) with respect to the edges of the document 10 (FIG. 1) as well as the thickness of the document. Furthermore, input can be received as to whether the branding image 40 is to appear multiple times on the document. Also, input can be received as to which side, i.e. a front side and/or a rear side, of the page 12 are the sub-images to be printed. A different branding image can be provided on the front side of the pages of the document as compared to the rear side, and vice versa. Furthermore, input can be received regarding the font, size, color, etc. for the branding image.

Figure 7:
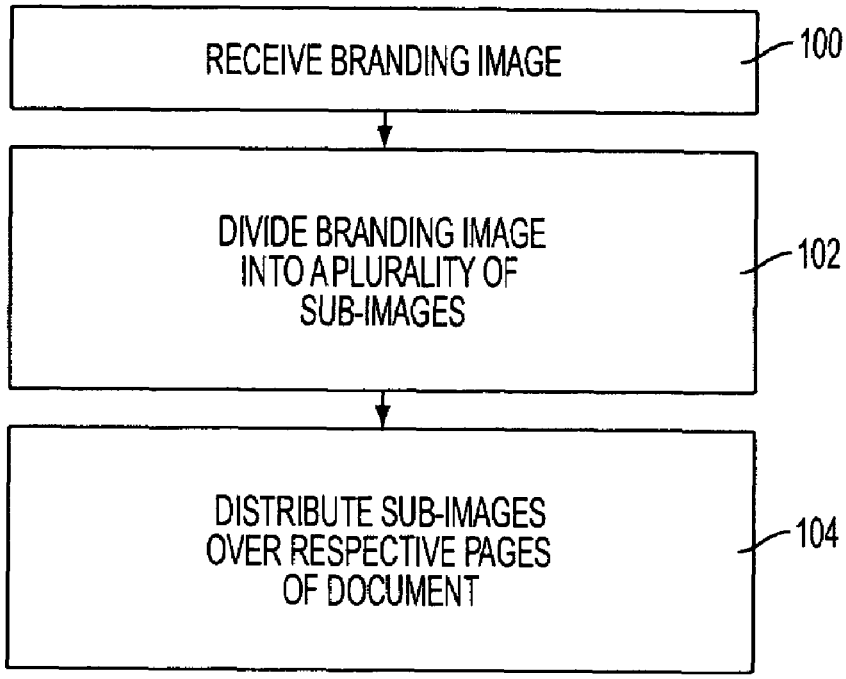
FIG. 7 is a diagram of a method for branding a document

With continued reference to FIG. 7, after the branding image has been received, the branding image 40 then divided into a plurality of sub-images 102. As seen in FIG. 5, the branding image 40 can be divided into a plurality of sub-images 42. The sub-images can be taken as horizontal sections of the branding image, which is shown in FIG. 5 or other sections such as vertical sections, diagonal sections, other angled sections, as well as smallertwo-dimensional elements, for example small pixels and the like, can also be formed. The number of sub-images that the branding image 40 (FIG. 4) is divided into can be a function of user input, e.g. alignment, font, size, as well as the number of pages of the document 10 (FIG. 1). Furthermore, the dimensions of each sub-image, e.g. the height of each slice, can also be a function of user input and the number of pages in the multi-page document 10 (FIG. 1). Also, the orientation of the sub-images, e.g. whether the images are vertical or horizontal segments, can also be a function of the user input. Alternatively, default values or calculations can be used for these parameters.

With further reference to FIG. 7, after dividing the branding image into a plurality of sub-images, the sub-images 102 are distributed over respective pages of the document 104. Typically, each sequential sub-image 42 (FIG. 5) is disposed on each sequential page 12 of the document 10 (FIG. 1). Nevertheless, more than one sub-image can be provided on a single page, or sub-images can be repeated on subsequent pages. Also, sub-images need not be placed on each sequential page. For example, sub-images can be provided on every other page, or similar; however, if pages are skipped the sub-image may appear less bold.

After the sub-images have been distributed over the respective pages of document 10, the document is printed by the printer 60 such that the text 30 (FIG. 2) is disposed generally in the central region 32 of the page 12 and each sub-image 42 is disposed adjacent an edge of the page 12, this edge typically being one of the unbound edges. As seen in FIG. 8 to further obfuscate each sub-image on the page 12 of the document 10, the sub-image can be printed in a decorative border 80 that surrounds the central region 32 of the page 12.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims. The claims can encompass embodiments in hardware, software or a combination thereof.

The invention claimed is:

1. A method for branding a document, the method comprising:

receiving a branding image for a multi-page document that is to be bound adjacent a bound edge;

dividing the branding image into a plurality of sub-images; and distributing the plurality of sub-images over a respective plurality of pages of the multi-page document, the sub-images being distributed adjacent an edge of the respective pages other than the bound edge, the sub-images being located so that the sub-images appear as a reconstructed version of the branding image only when the respective pages of the multi-page document are manipulated in preparation to be flipped.

2. The method of claim 1, wherein dividing the branding image comprises dividing the branding image into horizontal slices, vertical slices, angled slices, or two-dimensional elements.

3. The method of claim 1, wherein distributing the plurality of sub-images comprises distributing one sequential sub-image per one sequential page.

4. The method of claim 1, wherein distributing the plurality of sub-images comprises distributing at least one sub-image per page.

5. The method of claim 1, wherein the branding image comprises text, a graphical image, a banner, a logo or a picture.

6. The method of claim 1, further comprising receiving a designation as to which side of the respective pages the sub-images are to be printed.

7. The method of claim 1, further comprising aligning the branding image along a width or height of the respective pages.

8. The method of claim 7, further comprising aligning the branding image with respect to a thickness of the multi-page document.

9. The method of claim 1, wherein dividing the branding image further comprises dividing the branding image into a plurality of sub-images as a function of the number of pages of the multi-page document.

10. The method of claim 1, wherein distributing the plurality of sub-images comprises distributing respective sub-images at or adjacent a first edge of respective pages, the first edge being opposite a second edge of the respective pages, the second edge being at or adjacent where the multi-page document is to be bound.

11. The method of claim 1, receiving input regarding the location of the branding image with respect to a dimension of the multi-page document.

12. The method of claim 1, wherein distributing the plurality of sub-images comprises distributing the sub-images in a decorative border that surrounds a central region of a respective page.

13. A method for branding a document comprising:

receiving a branding image for a document having a plurality of pages;

dividing the branding image into a plurality of sub-images;

distributing respective sub-images over respective pages of the document adjacent respective front or rear selected edges of the respective pages, the sub-images being distributed whereby if a printed version of the document is manipulated to expose the selected edges then the sub-images appear as a reconstructed version of the branding image; and obfuscating the respective sub-images over respective pages of the document.

14. The method of claim 13, wherein distributing further comprises combining respective sub-images with respective images located in a central region of the respective pages.

15. The method of claim 14, wherein obfuscating the respective sub-images comprises locating respective sub-images within a decorative border that surrounds the central region.

16. The method of claim 13, wherein dividing the branding image further comprises dividing the branding image into horizontal or vertical slices.

* * * * *